US008776422B2

(12) United States Patent
Dodd et al.

(10) Patent No.: US 8,776,422 B2
(45) Date of Patent: Jul. 15, 2014

(54) COMMUNICATION AND CONTROL OF ACCESSORIES MOUNTED ON THE POWERED RAIL OF A WEAPON

(75) Inventors: James S. Dodd, Linden, VA (US); Ben Feldman, Reston, VA (US); Tyler Miller, Falls Church, VA (US); Terrance Jordan, Lansdowne, VA (US); Greg Paulsen, Ashburn, VA (US)

(73) Assignee: Prototype Productions, Inc., Ashburn, VA (US)

( * ) Notice: Subject to any disclaimer, the term of this patent is extended or adjusted under 35 U.S.C. 154(b) by 0 days.

(21) Appl. No.: 13/357,514

(22) Filed: Jan. 24, 2012

(65) Prior Publication Data

US 2013/0185978 A1 Jul. 25, 2013

(51) Int. Cl.
*F41C 23/16* (2006.01)
*F41C 23/00* (2006.01)

(52) U.S. Cl.
USPC ..... 42/72; 42/84; 42/85; 42/90

(58) Field of Classification Search
USPC ..... 42/90, 84, 72, 71.01, 85
See application file for complete search history.

(56) References Cited

U.S. PATENT DOCUMENTS

| | | | | |
|---|---|---|---|---|
| 7,627,975 | B1 * | 12/2009 | Hines | 42/84 |
| 7,640,690 | B2 * | 1/2010 | Hines | 42/75.03 |
| 7,975,419 | B2 * | 7/2011 | Darian | 42/84 |
| 8,028,459 | B2 * | 10/2011 | Williams | 42/90 |
| 8,028,460 | B2 * | 10/2011 | Williams | 42/90 |
| 8,091,265 | B1 * | 1/2012 | Teetzel et al. | 42/72 |
| 8,104,211 | B2 * | 1/2012 | Darian | 42/90 |
| 8,141,288 | B2 * | 3/2012 | Dodd et al. | 42/84 |
| 8,146,282 | B2 * | 4/2012 | Cabahug et al. | 42/85 |
| 8,151,505 | B2 * | 4/2012 | Thompson | 42/84 |
| 8,225,542 | B2 * | 7/2012 | Houde-Walter | 42/72 |
| 8,225,544 | B2 * | 7/2012 | Darian | 42/90 |
| 8,322,064 | B2 * | 12/2012 | Cabahug et al. | 42/85 |
| 8,347,541 | B1 * | 1/2013 | Thompson | 42/84 |
| 8,448,368 | B2 * | 5/2013 | Cabahug et al. | 42/85 |
| 8,458,944 | B2 * | 6/2013 | Houde-Walter | 42/72 |
| 8,516,731 | B2 * | 8/2013 | Cabahug et al. | 42/84 |
| 2009/0108589 | A1 * | 4/2009 | Racho | 290/1 R |
| 2010/0031552 | A1 | 2/2010 | Houde-Walter | |
| 2010/0083553 | A1 * | 4/2010 | Montgomery | 42/84 |
| 2010/0180485 | A1 | 7/2010 | Cabahug et al. | |
| 2010/0192443 | A1 | 8/2010 | Cabahug et al. | |
| 2010/0192444 | A1 * | 8/2010 | Cabahug et al. | 42/71.02 |
| 2010/0192446 | A1 * | 8/2010 | Darian | 42/84 |

(Continued)

OTHER PUBLICATIONS

International Search Report in PCT Application No. PCT/US2012/069760 dated Mar. 7, 2013, 3 pages.

*Primary Examiner* — Jonathan C Weber
(74) *Attorney, Agent, or Firm* — Squire Patton Boggs (US) LLP

(57) ABSTRACT

A firearm used in military applications may have a plurality of accessories that can be attached to the weapon, with each accessory having a need for electric power. In order to reduce the weight of these power-consuming accessories, as well as the proliferation of batteries used to power these power-consuming accessories, a Powered Rail provides a point of mechanical and electrical interconnection for the power-consuming accessories with a common power source. The Weapon Accessory Control System is provided to enable the user to control the activation of a power-consuming accessory as well as enable communications between the user and the power-consuming accessory and among power-consuming accessories.

20 Claims, 10 Drawing Sheets

(56) References Cited

U.S. PATENT DOCUMENTS

| | | | | |
|---|---|---|---|---|
| 2010/0192447 | A1* | 8/2010 | Cabahug et al. | 42/84 |
| 2010/0192448 | A1* | 8/2010 | Darian | 42/84 |
| 2010/0218410 | A1 | 9/2010 | Cabahug et al. | |
| 2010/0275489 | A1 | 11/2010 | Cabahug et al. | |
| 2010/0287809 | A1* | 11/2010 | Williams | 42/90 |
| 2011/0000120 | A1* | 1/2011 | Thompson | 42/84 |
| 2011/0010979 | A1* | 1/2011 | Houde-Walter | 42/84 |
| 2011/0061284 | A1* | 3/2011 | Cabahug et al. | 42/73 |
| 2011/0131858 | A1* | 6/2011 | Darian | 42/90 |
| 2011/0173865 | A1 | 7/2011 | Compton et al. | |
| 2011/0185617 | A1* | 8/2011 | Brixius | 42/71.01 |
| 2011/0214328 | A1* | 9/2011 | Williams | 42/90 |
| 2011/0283585 | A1* | 11/2011 | Cabahug et al. | 42/73 |
| 2012/0144716 | A1 | 6/2012 | Cabahug et al. | |
| 2012/0192476 | A1* | 8/2012 | Compton et al. | 42/84 |
| 2012/0285064 | A1* | 11/2012 | Houde-Walter | 42/72 |
| 2013/0061504 | A1* | 3/2013 | Malherbe et al. | 42/84 |
| 2013/0185978 | A1* | 7/2013 | Dodd et al. | 42/84 |
| 2014/0047754 | A1* | 2/2014 | Compton et al. | 42/84 |

* cited by examiner

COMMUNICATION AND CONTROL OF ACCESSORIES MOUNTED ON THE POWERED RAIL OF A WEAPON

STATEMENT REGARDING FEDERALLY SPONSORED RESEARCH OR DEVELOPMENT

This application is sponsored by the US Department of Defense under Contract Numbers W15QKN-08-C-0072 and W15QKN-09-C-0045.

FIELD OF THE INVENTION

The invention relates to a communications and control system for use with a Powered Rail of a weapon to provide communications and control signals as well as electric power to power-consuming accessories mounted on the Powered Rail.

BACKGROUND OF THE INVENTION

It is a problem to distribute command and control signals to power-consuming accessories, which are operationally associated with a weapon and attached to the weapon's Powered Rail, that electrically connects the power-consuming accessories to a centrally located power source. A weapon used in military applications may have a plurality of accessories that can be attached to the weapon, with each accessory having a need for electric power. In order to reduce the weight of these power-consuming accessories, as well as the proliferation of batteries used to power these power-consuming accessories, a common power source is used to power whatever power-consuming accessory is attached to the weapon. A Powered Rail provides a point of mechanical and electrical interconnection for the power-consuming accessories to provide quick connect mounting and dismounting of the power-consuming accessory, absent the use of connectors with their tethering cables, which are susceptible to entanglement.

However, a Powered Rail by itself fails to provide a user with control over the operation of the power-consuming accessories, since it simply provides an electrical connection to the power source and must rely on a power switch mounted on each power-consuming accessory to enable the user to apply power in a binary, on/off manner to that power-consuming accessory. The need to operate such a switch on a power-consuming accessory is inconvenient and prevents the user from having the ability to rapidly power-up and power-down the power-consuming accessory. In the case of a plurality of power-consuming accessories being mounted on the weapon, such a power control method is cumbersome at best.

In addition to providing an accessory on/off function, there is a need to support control signal distribution from a centrally located control apparatus to the accessories as well as intra-accessory communications absent the presence of a centrally located control apparatus. With a limited amount of power available from the power source and the ability of the user to connect and disconnect accessories to the Powered Rail, any communications and control distribution system must be simple, efficient, and adaptable to account for new types of accessories being developed and deployed on the weapon.

BRIEF SUMMARY OF THE INVENTION

The above-described problems are solved and a technical advance achieved by the present Communication And Control Of Accessories Mounted On The Powered Rail Of A Weapon (termed "Weapon Accessory Control System" herein) which is adapted for use in weapons, such as military weapons, that are equipped with a Powered Rail. The Powered Rail is electrically interconnected with a power source, and the Weapon Accessory Control System is provided to enable the user to control the activation of a power-consuming accessory from a centrally located control interface. In addition, the control and communication architecture enables communications not only between the user and the power-consuming accessories but also among power-consuming accessories, independent of the presence of a centrally located control apparatus.

DETAILED DESCRIPTION OF THE PREFERRED EMBODIMENT

The use of a Powered Rail on a weapon serves multiple types of power-consuming accessories such as: tactical lights, laser aiming modules, night vision devices, and reflex sights. The Powered Rail can be incorporated on the top, bottom, or sides of the rifle barrel, the underside of semi-automatic pistol frames, and even on weapon grips. Regardless of the location and implementation of the Powered Rail, the problem of control and communication with and among the power-consuming accessories is a universal issue.

Weapon Equipped With Weapon Accessory Power Distribution System

Figure 1A:
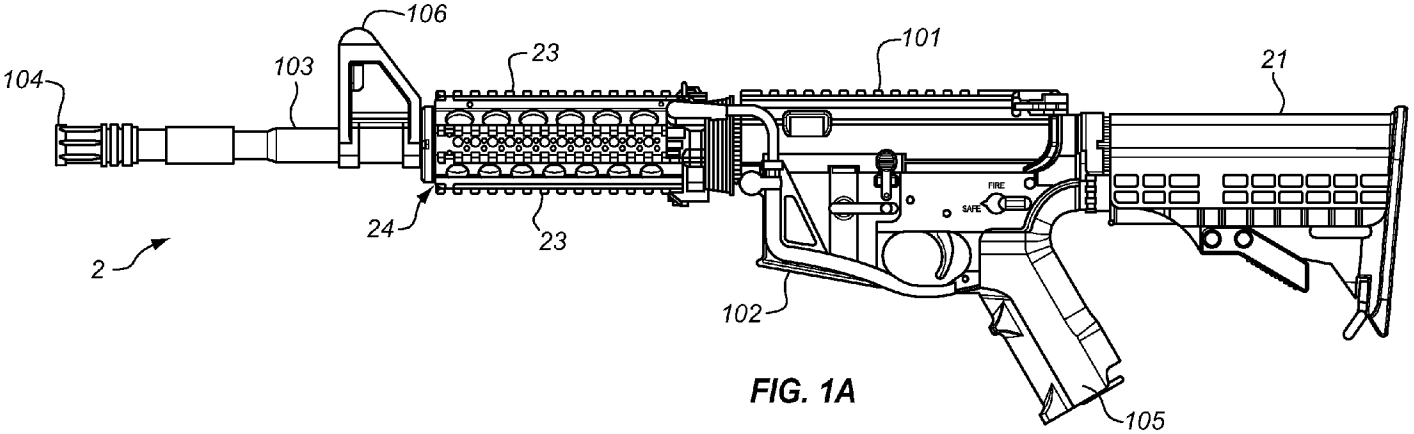
FIGS. 1A and 1B are illustrations of the system architecture of a military style weapon equipped with a Weapon Accessory Power Distribution System.
Figure 1B:
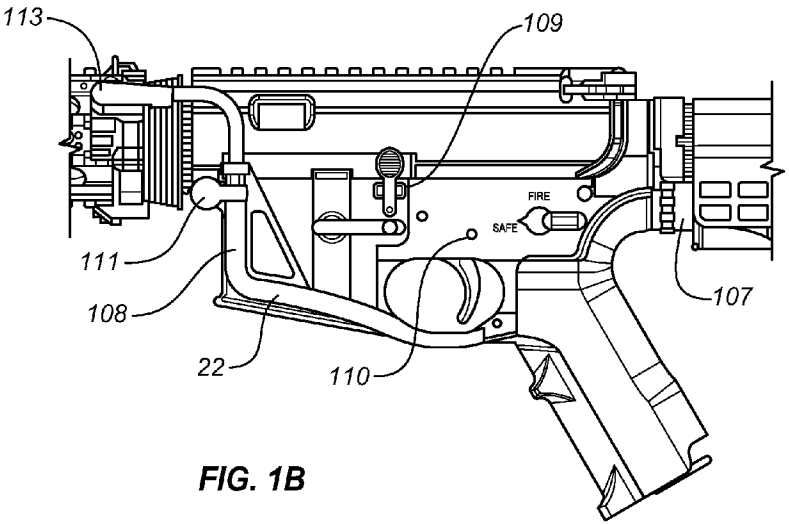
Figure 2B:
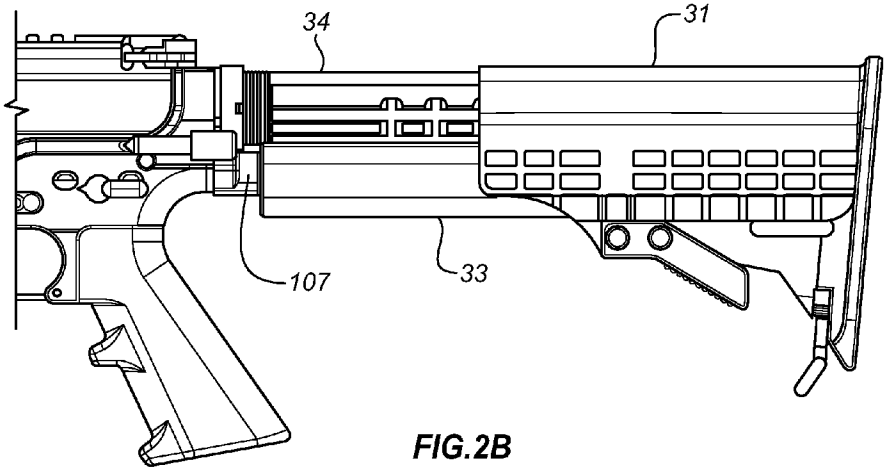
FIGS. 2A and 2B are illustrations of a typical butt stock battery pack of the Weapon Accessory Power Distribution System.
Figure 2A:
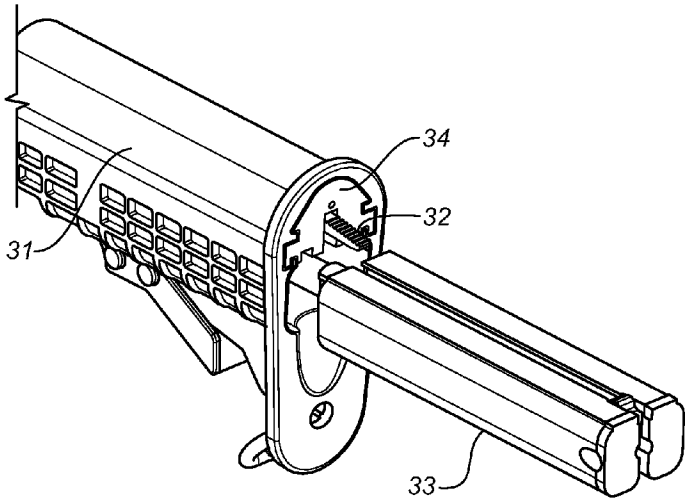
Figure 3A:
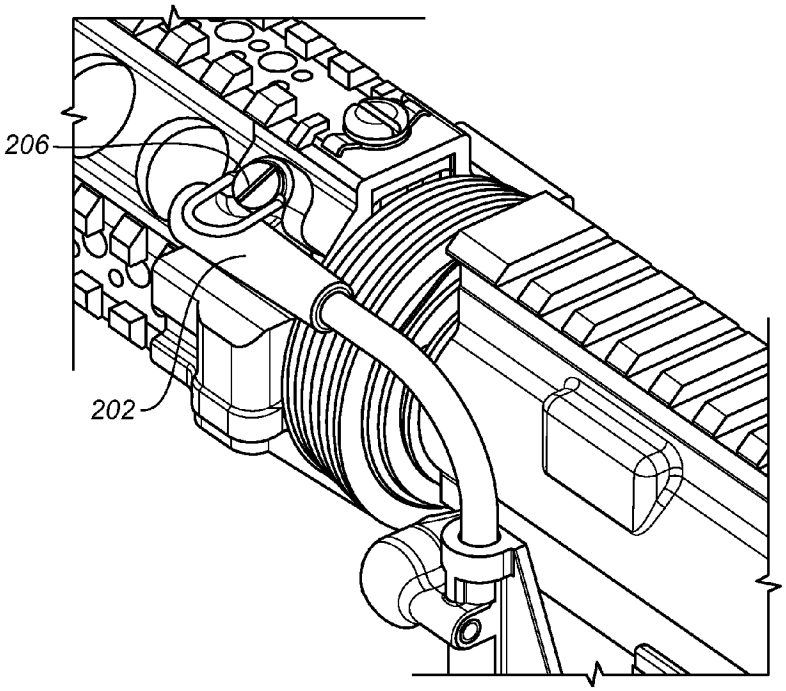
FIGS. 3A-3C are illustrations of the Power Distribution System which interconnects the Battery Pack to the Powered Rail in the Weapon Accessory Power Distribution System.
Figure 3B:
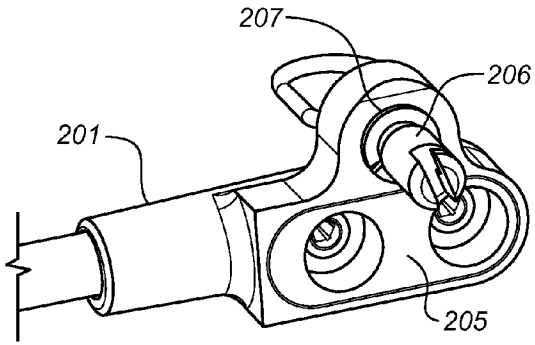
Figure 3C:
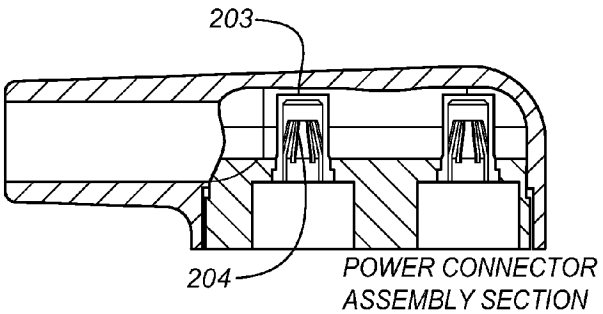

FIGS. 1A and 1B are illustrations of the system architecture of a military style weapon 2 equipped with a Weapon Accessory Power Distribution System. The primary components of the basic Weapon Accessory Power Distribution System are:

Butt Stock 21 with Battery Pack 33 (shown in FIG. 2A);
Power Distribution System 22;
Handguard 23 (optional);
Powered Rail 24; and
Powered Accessory Mounting 25 (shown in FIG. 5).

The existing military-style weapon 2 includes in well-known fashion an upper receiver 101, lower receiver 102, barrel 103, muzzle 104, grip 105, and front sight 106. While a military-style weapon is described herein, the teachings of this application are equally applicable to other firearms, such as handguns, fixed-mount machine guns, as well as non-weapon based systems, such as air-soft (paint ball) systems. The Weapon Accessory Power Distribution System is added to this standard military-style weapon 2 as described herein.

The Handguard 23 performs the barrel shielding function as in the Picatinny Rail noted above, but has been modified, as shown in FIGS. 1A and 1B, to accommodate the Powered Rail 24 and electrical interconnection of the Powered Accessory Mounting 25 to the Powered Rail 24, as described below. In particular, a combination of Powered Rails 24 and Handguard sections 23 are attached together to form a structure which encircles the barrel 103. The Powered Rail 24 in effect forms facets around the periphery of the resultant Handguard structure. Thus, herein the term "Handguard" is used to represent the sections of handguard structure as well as the well-known combination of Handguard sections and Powered Rails which encircle the barrel 103 as shown in FIGS. 1A and 1B. As alternative structures, the Powered Rail 24 can be attached to a Handguard 23 that encircles the barrel. Furthermore, there is no requirement to use the Handguard 23 as an integral component of the Weapon Accessory Power Distribution System, so the Handguard 23 can be optional, with the Powered Rail(s) 24 being attached to the weapon in some other manner, such as an upper receiver rail 101 in FIG. 1A. For the purpose of illustrating the Weapon Accessory Power Distribution System, the first of the above-listed configurations is used herein.

Handguard

As noted above, the Handguard 23 was developed to shroud the barrel 103 of a rapid fire weapon 2 to enable the person firing the weapon 2 to grip the forward portion of the weapon 2 while mitigating the possibility of burning the hand of the person firing the weapon 2, yet also providing adequate cooling for the barrel 103 of the weapon. Handguards find application in rifles, carbines, and fixed mount weapons, such as machine guns. However, the Weapon Accessory Control System can also be used in modified form for handguns, as an accessory mounting platform and as an accessory power source.

Figure 4A:
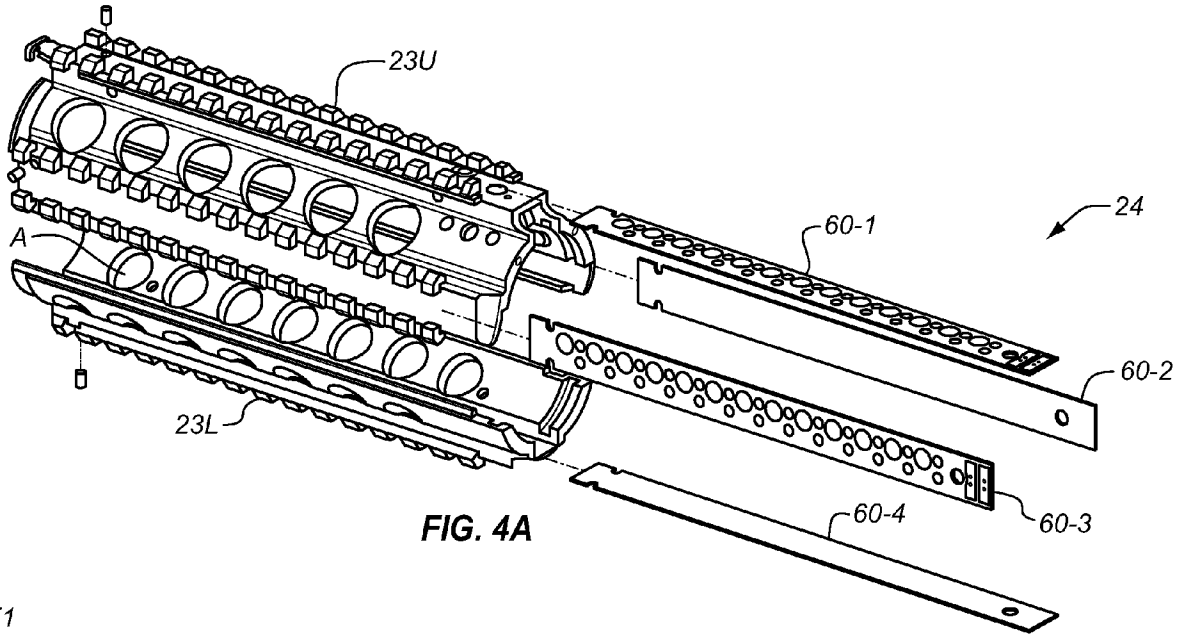
FIGS. 4A-4C are illustrations of the Handguard assembly, including the Powered Rail, of the Weapon Accessory Power Distribution System.
Figure 4B:
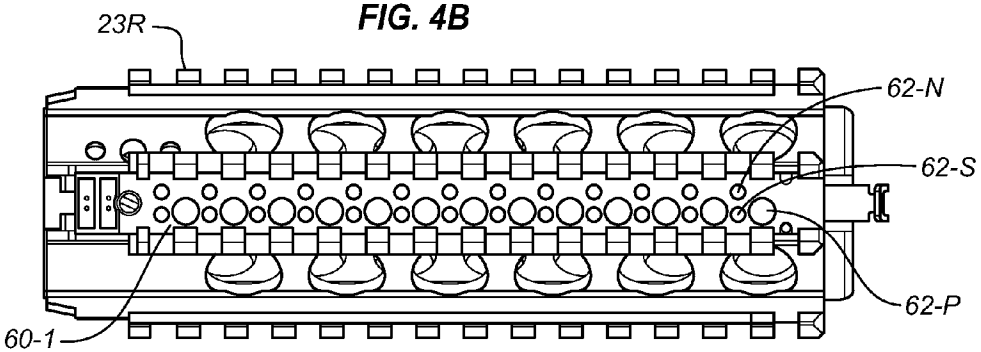
Figure 4C:
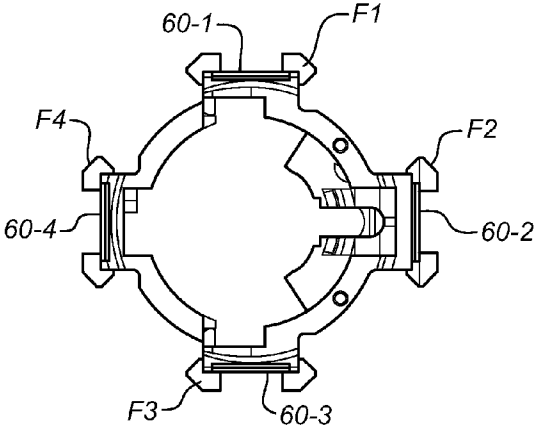
Figure 5:
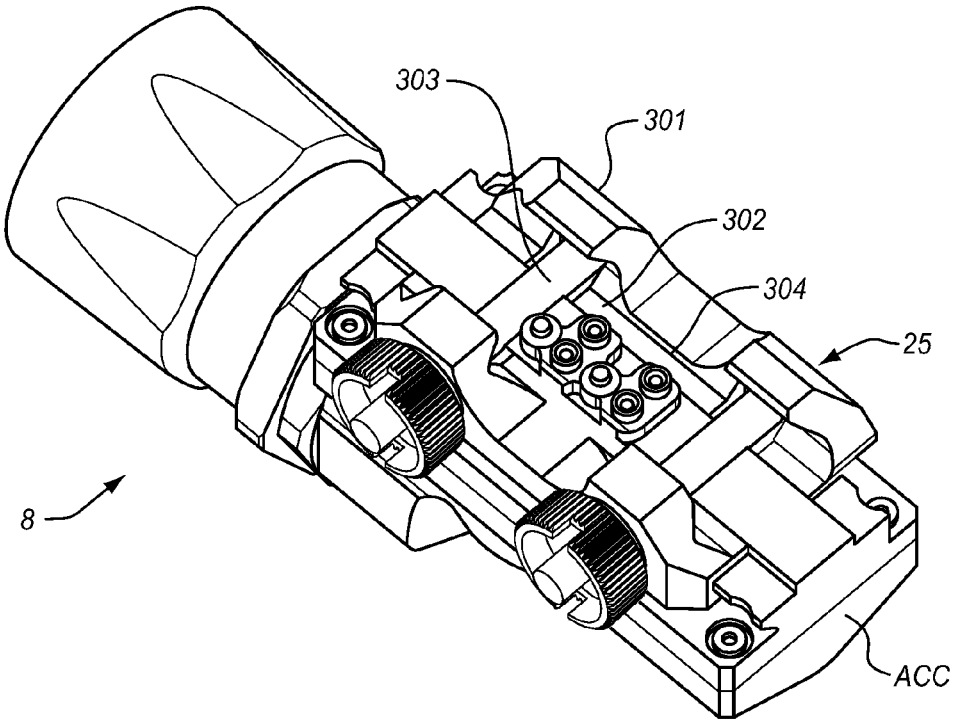
FIG. 5 illustrates the typical mechanical interconnection and electrical interconnection of a power-consuming accessory to the Handguard and Powered Rail.

FIGS. 4A-4C are perspective exploded view, side view, and end view illustrations, respectively, of the Handguard 23 assembly, including the Powered Rail 24, of the Weapon Accessory Control System. The Powered Rail 24, as shown as an example, includes a series of ridges with a T-shaped cross-section interspersed with flat "spacing slots." This version of the Handguard 23 includes one or more power distribution Printed Circuit Boards 60-1 to 60-4, with FIG. 5 showing an end view of the slots formed in the various facets F1-F4 of the Handguard 23. Apertures A are provided along the length dimension L of the Handguard 23 to enable the barrel 103 of the weapon 2 to be cooled by air circulation from the ambient environment. Other Powered Rail configurations are possible, and this architecture is provided as an illustration of the concepts of the Weapon Accessory Power Distribution System.

One or more of the Powered Rail subassemblies (typically Printed Circuit Boards) 60-1 to 60-4 can be inserted into the respective slots formed in the Powered Rail 24 (on the corresponding facets F1-F4 of the Handguard 23) thereby to enable power-consuming accessories to be attached to the Handguard 23 of the weapon 2 via the Powered Rail 24 on any facet F1-F4 of the Handguard 23 and to be powered by the corresponding power conductors 62-P and 62-N activated by switch 62-S formed on Printed Circuit Board 60-1 to 60-4 which are installed in the Powered Rail 24 on the respective facets.

Battery Pack

The Battery Pack can be implemented in a number of assemblies and mounted on various portions of the weapon (such as on the Powered Rail, or in a pistol grip, or in a remote power source, and the like) as described in U.S. patent application Ser. No. 12/689,438 filed on Jan. 19, 2010, titled "Rifle Accessory Rail, Communication, And Power Transfer System—Battery Pack." For the purpose of this description, FIGS. 2A and 2B are illustrations of a typical Butt Stock 21 with Battery Pack 33 of the Weapon Accessory Control System. For example, a butt stock/recoil tube battery pack assembly includes an adjustable butt stock 21, a cam latch 32, and a removable battery pack 33. The butt stock 21 adds a compartment to the underside of the existing lower receiver extension (also termed "buffer tube" herein) assembly 34 which allows the battery pack 33 to be installed and withdrawn for removal through the rear of the rifle. The battery pack 33 mounts on the buffer tube assembly 34 independent of the butt stock 21 which telescopes along the rifle. The butt stock 21 is adjustable and can be extended in various multiple intermediate positions to provide an adjustable length of the firearm, as is well known in the art. By moving the mass of the battery rearward on the weapon, the time required to bring the weapon to point is reduced, as well as the time needed to "stop" the muzzle when the target is acquired.

Power Distribution System

The Power Distribution System 22 is shown in FIGS. 1A, 1B, and 3A-3C as a one-piece housing 201 and ruggedized power rail connector 202 where sealing integrity is maintained during exposure to adverse environmental conditions. The power rail connector 202 consists of a metallic shell body, contact pin receptacle 203, with a press fit multi-finger spring contact 204 assembled into the contact pin receptacle 203. The multi-finger spring contact 204 provides compliance to variations in the mating pin to ensure continuous current carrying capacity of the connection. The contact pin receptacle 203 includes a solder tail portion for soldering cable wires. The bottom panel insulator 205 mounts the pin receptacle 203 with the bottom part and fitted over the connector contact pin receptacle 203 and is sealed with a sealing compound. A fastener 206 and retaining ring 207 are used to secure the connector assembly into the rail pin contacts.

An electric wire is routed from the Battery Pack 33 in the Butt Stock 21 to the Powered Rail 24. The external wiring is housed inside a durable and impact-resistant polymer shroud 108 that conforms to the lower receiver 102. The shroud is securely retained by a quick connect/disconnect pivot and takedown pin 111, as well as the bolt release roll pin 109 in the trigger/hammer pins 110. The shrouded power cable runs from the Battery Power Connector 107 at the Battery Pack 33 to the Power Rail Connector 202. This design provides an easy access for replacing or repairing the cable assembly, eliminates snag hazards or interferences with the rifle operation, and requires no modifications to the rifle lower receiver 102 housing.

Powered Rail

The Powered Rail 24 is used to electrically interconnect a power source (Battery Pack 33) with the various power-consuming accessories 7, 8 mounted on the Powered Rail 24, such that the Powered Rail 24 of the Handguard 23 provides the mechanical support for the power-consuming accessories 7, 8; and the Powered Rail 24 also provides the electrical interconnection. In this example, the Powered Rail 24 is attached to and coextensive with the Handguard 23 sections, such that the mounting of a Power-Consuming Accessory 7, 8 on the Powered Rail 24 results in simultaneous mechanical and electrical interconnection.

Power Consuming Accessory Mounting

FIG. 5 is an illustration of the typical mechanical interconnection and electrical interconnection of a power-consuming accessory (such as flashlight 8 or night vision device 7) to the Handguard 23 and Powered Rail 24. The perspective view of FIG. 5 shows how the Powered Accessory Mounting 25 attaches the power-consuming accessory 8 to the Powered Rail 24 and consists of a rail grabber 301, spring contacts 302, spring plungers 303, and face seals 304. The spring plungers 303 depress the snap-dome switches on the Powered Rail 24, the spring contacts 302 provide electrical contact with the fixed electrical bus contacts 62M and 62P-* on the Powered Rail 24 Printed Circuit Board assembly, and the face seals 304 provide environmental protection.

Weapon Accessory Control System

Figure 6A:
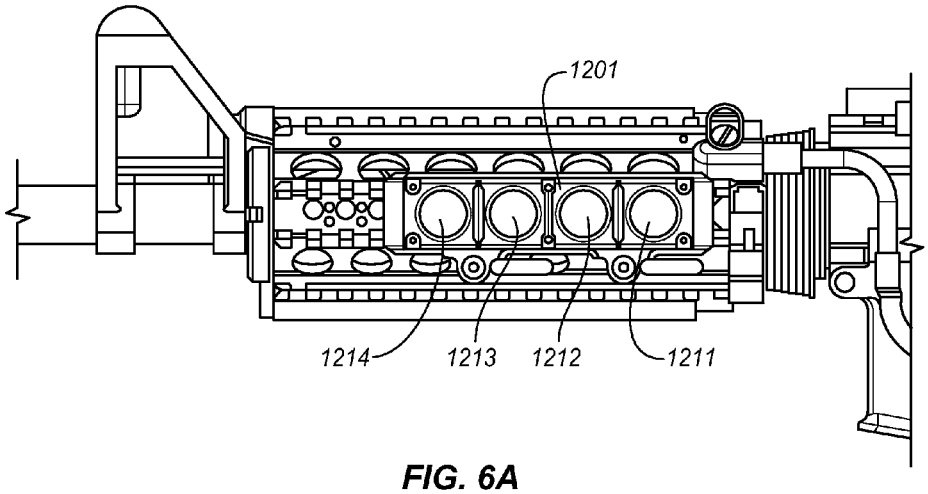
FIGS. 6A and 6B illustrate side views of two implementations of typical power-consuming accessory control modules of the Weapon Accessory Control System.
Figure 6B:
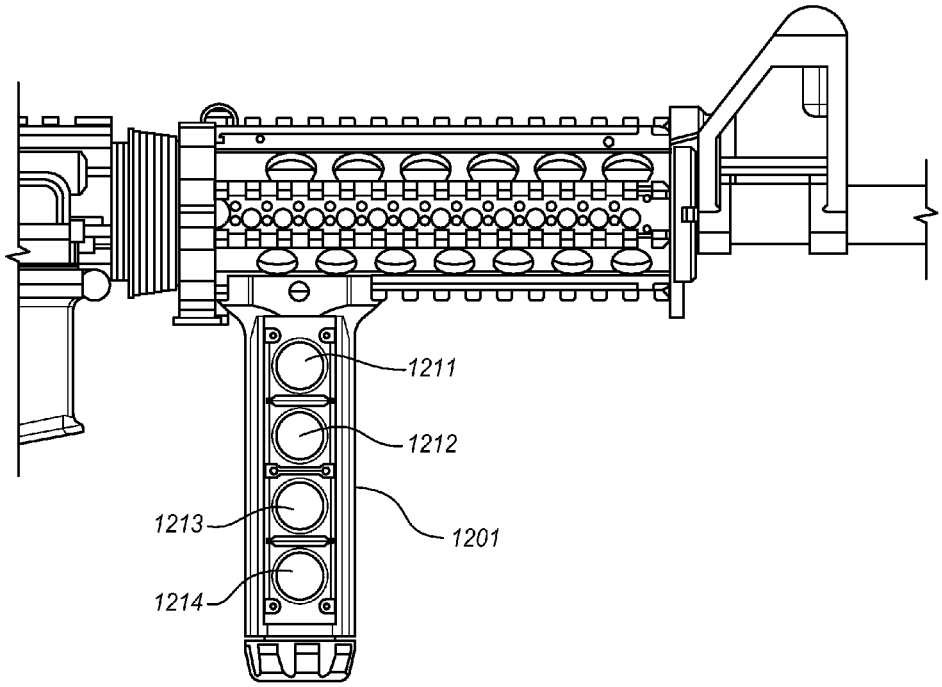
Figure 7:
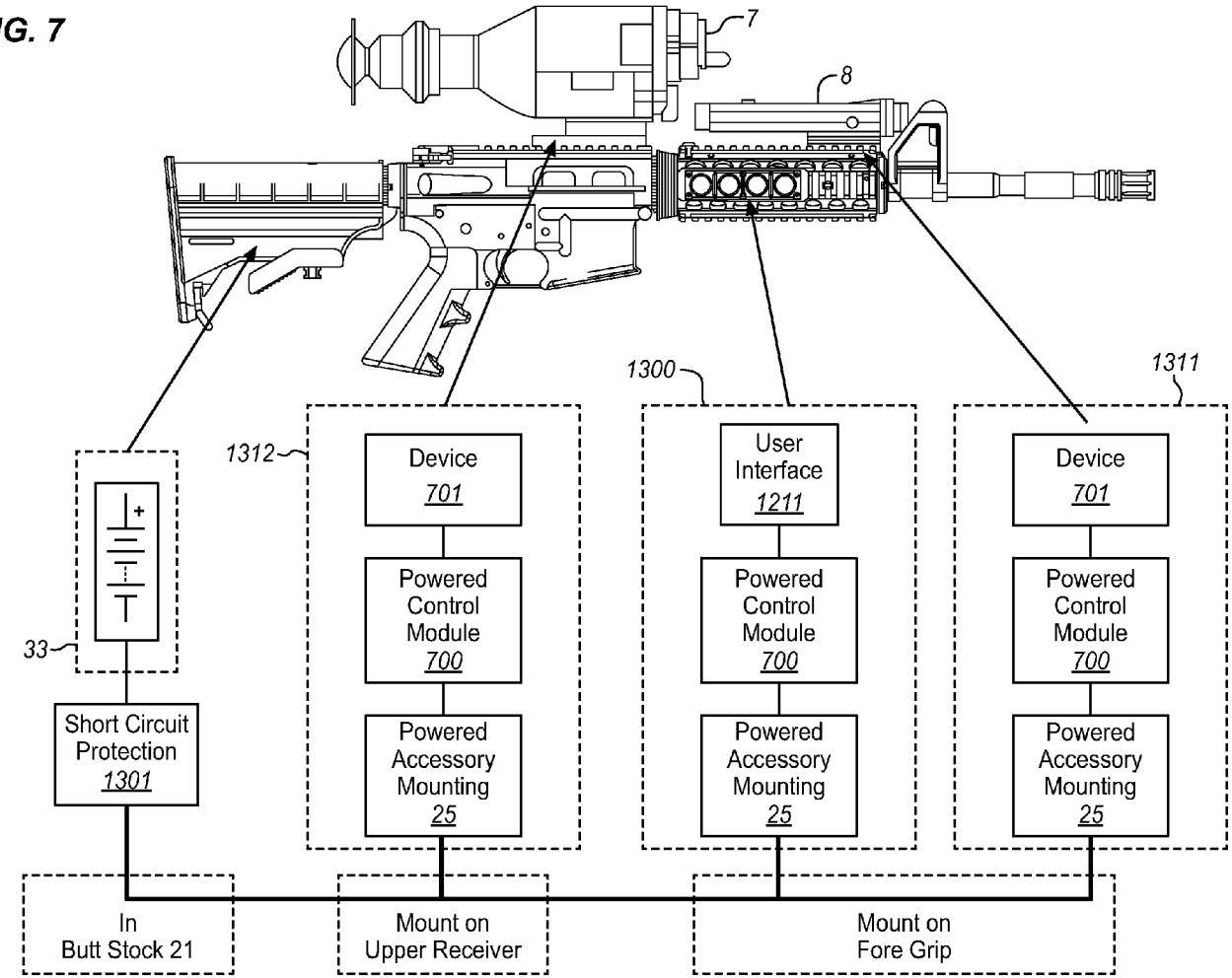
FIG. 7 illustrates a circuit diagram of the interconnection of elements in a typical Weapon Accessory Control System.

FIGS. 6A and 6B illustrate side views of two implementations of a typical user interface 1201 of the Weapon Accessory Control System 1300; and FIG. 7 illustrates a circuit diagram of a typical weapon that is equipped with the Weapon Accessory Control System 1300 and a plurality of power-consuming accessories 7, 8 and their associated Powered Control Modules 700. The Weapon Accessory Control System 1300 consists of a Powered Control Module 700, Powered Accessory Mounting 25, and User Interface 1201, and functions as the Master in a Master-Slave relationship with the power-consuming accessories (Slave), each of which are equipped with control circuits 1311, 1312, each of which includes a Powered Control Module 700, Powered Accessory Mounting 25, and some power-consuming device 701, which is a component of a power-consuming accessory, such as a tactical light 8, laser aiming module, night vision device 7, or reflex sight.

The Weapon Accessory Control System User Interface 1201 is shown in both the horizontal (juxtaposed to and substantially parallel to the barrel of the weapon) and vertical grip (extending in a downward direction and substantially perpendicular to the barrel of the weapon) designs in FIGS. 6A and 6B, respectively. The Weapon Accessory Control System 1300 has the ability to pass command and control signals over the Powered Rail 24 in order to activate and de-activate power-consuming accessories 7, 8 which are mounted on the Powered Rail 24, as well as to provide power-consuming accessory identification and status. Communications between the control circuits 1312, 1311 contained in the respective power-consuming accessories 7, 8 and the Weapon Accessory Control System 1300 are accomplished by impressing a modulated signal on the power supply conductors 62-P, 62-N of the Powered Rail 24. This reduces the number of conductors required to distribute communications and confines the control signals to the Powered Rail 24 assembly.

Figure 8:
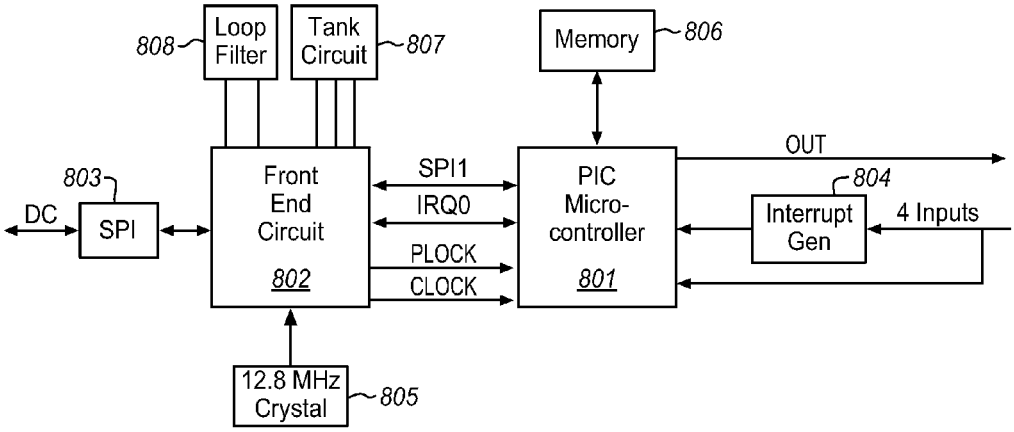
FIG. 8 illustrates in block diagram form the architecture of the Powered Control Module.

As shown in FIG. 7, the Battery Pack 33 contains a power source which is interconnected to the Powered Rail 24 as described above, typically through a short-circuit protection circuit 1301. Each power-consuming accessory 7, 8, as described above, is mechanically and electrically connected to the Powered Rail 24 via, for example, the Powered Accessory Mounting 25, and includes a Powered Control Module 700 which provides the control and communications circuitry to regulate the provision of power to the associated power-consuming device 701 as well as status and control intercommunications among the power-consuming accessories 7,8 and the Weapon Accessory Control System 1300. As shown in FIG. 8, the Powered Control Module 700 with optional selector switches (not shown) built into the power-consuming accessories 7, 8, enables the unique identification of specific power-consuming accessories 7, 8 and the regulation of power applied to the power-consuming device 701 of the power-consuming accessories 7, 8. In particular, the associated Powered Control Module 700 in each power-consuming accessories 7, 8 can be programmed to respond to a particular control signal which is unique to power-consuming accessories 7, 8, or can optionally utilize one or more selector switches which assign a user control button identification signal which corresponds to a desired functionality for the designated power-consuming accessories 7, 8. In addition, the power-consuming accessories 7,8 are plug-and-play in nature in that they can be self-initializing if the Weapon Accessory Control System 1300 is absent or powered down or unable to communicate with the power-consuming accessories 7,8.

Furthermore, the Weapon Accessory Control System 1300 is typically equipped with a plurality of switches 1211-1214 in the user interface 1201, each of which typically controls a different power-consuming accessory 7, 8 via the use of a predetermined signaling paradigm. As an example, if the user wanted to momentarily power a target illuminator 8, they would hold down switch 1211, which would power the target illuminator 8 via the Powered Control Module 700 resident in target illuminator 8 (part of circuitry 1311) as long as the switch 1211 was operated. If they wanted to maintain power to the target illuminator 8, they would press and release switch 1211. To turn off the target illuminator 8, they would press switch 1211 again. Alternatively, different combinations of switches and switch activation sequences could activate functions on any number of power-consuming accessories 7, 8.

In order to implement this signal paradigm, each of switches 1211-1214 (and their mode of operation) would result in a uniquely coded signal being impressed on the Powered Rail 24. The Powered Control Module 700 generates the predetermined unique signal (for example, different frequency signals) which is associated with the operated switch 1211. This unique signal is impressed on the Powered Rail 24 via Front End Circuit 802 of the Powered Control Module 700. Since both the power-consuming accessories 7, 8 and the Weapon Accessory Control System 1300 are equipped with respective Powered Control Modules 700, bidirectional communications between the power-consuming accessories 7, 8 and the Weapon Accessory Control System 1300 is possible, as well as between the power-consuming accessories 7,8.

Power Consuming Accessory Management

The management of the power-consuming accessories is accomplished by the operation of Weapon Accessory Control System 1300, which implements various functions including, but not limited to:

- Communications over Powered Rail 24 to power-consuming accessories 7, 8;
- Prioritizes the power control function for power-consuming accessories 7, 8;
- Manages the power control function for the battery pack's capability (charge, type of batteries, configuration);
- Learns power-consuming accessory use over time to determine priorities automatically—this can be manually overridden by the user; and
- Able to manage the applied voltage and disable features from specific power-consuming accessories as the available level of power diminishes.

The small footprint of the Weapon Accessory Control System 1300, and the number of power-consuming accessories 7, 8 which may be attached to the Powered Rail 24, mandates that the power consumption of Weapon Accessory Control System 1300 must be minimized. This is accomplished through a combination of lowering the clock rate, and/or entering sleep modes, depending on the role of the Weapon Accessory Control System 1300, after idle time is detected.

The software which executes on Powered Control Module 700 must also be capable of operating reliably in the presence of noise on the Powered Rail 24, via the operation of Loop Filter 808. In this context, noise is any event that interferes with the successful transmission and reception of a packet, such as the attachment of a new power-consuming accessory 7, 8 to the Powered Rail 24. Because power-consuming accessories 7, 8 can be attached to or removed from the Powered Rail 24 at any time, the software which executes in the Powered Control Module 700 must dynamically detect the installation of a new power-consuming accessory 7, 8, and the removal of a power-consuming accessory 7, 8, and adjust accordingly. Communications with power-consuming accessories 7, 8 is provided through a Front-End Circuit 802 which uses a high-speed Serial Peripheral Interface 803 to communicate with Microcontroller 801. A Crystal 805 and Tank Circuit 807 are provided to generate the various specific frequency clock signals. The Microcontroller 801 does not have an operating system, and the software is interrupt-driven, with a simple dispatching loop. The interrupts are received from the associated power-consuming accessory on lead(s) inputs and handled by Interrupt Generator 804. Responses, such as Pulse Width Modulation control signals, are returned to the power-consuming accessories 7, 8 via output lead Out.

Figure 9:
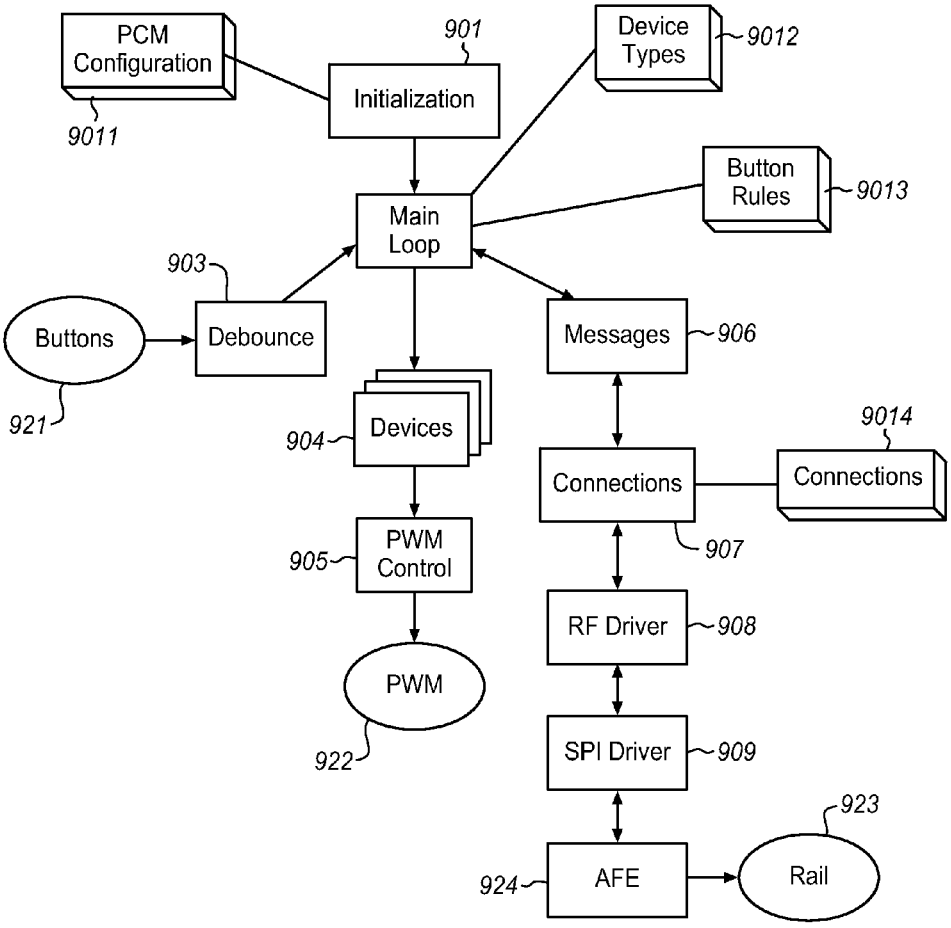
FIG. 9 illustrates in block diagram form the software architecture of the Powered Control Module.

The Weapon Accessory Control System 1300 also allows various power-consuming accessories 7, 8, attached to a common Powered Rail 24, to communicate with each other, using the Powered Rail power conductors 62-P, 62-N as a wired connection for low-power signals, typically in the 800+ MHz region of the spectrum. The associated communications software is a single module, having multiple software components (as shown in FIG. 9), that reside on the Memory 806 associated with Microcontroller 801, in various power-consuming accessories 7, 8. The role of a specific accessory Powered Control Module 700 changes as a function of the power-consuming accessories 7, 8 on which it executes. For example, a Powered Control Module 700 located in a first power-consuming accessory 7 monitors button press events and sends messages to another Powered Control Module 700 located in a second power-consuming accessory 8, commanding the other Powered Control Module 700 to turn a device on or off. For all Powered Control Modules 700, a single executable image is envisioned; the specific role that the image performs is a function of configuration information that is stored within flash memory on the power-consuming accessories 7, 8. Because power-consuming accessories 7, 8 can be attached or removed at any time, software must dynamically detect the installation of new power-consuming accessories 7, 8, and the removal of power-consuming accessories 7, 8, and adjust accordingly. In addition, the power-consuming accessories 7,8 can communicate among themselves absent the presence of the Weapon Accessory Control System 1300.

The heart of the Powered Control Module 700 is the Microcontroller 801 which includes a predetermined amount of memory 806 which stores an executable program, tables of data, and variable storage. Communications with other Powered Control Modules 700 are implemented via the Front End Device 802, and the Serial Peripheral Interface 803 enables the Microcontroller 801 and the Front End Circuit to communicate.

Serial Peripheral Interface

The Serial Peripheral Interface 803 is a synchronous serial data link that operates in full duplex mode. Devices communicate in master/slave mode where the master device initiates the data frame. Multiple slave devices are allowed with individual slave select (chip select) lines. The Serial Peripheral Interface 803 specifies four logic signals:

SCLK: Serial Clock (output from master);

MOSI; SIMO: Master Output, Slave Input (output from master);

MISO; SOMI: Master Input, Slave Output (output from slave);

SS: Slave Select (active low, output from master).

The convention requires that Serial Data Out on the master be connected to Serial Data In on the slave, and vice-versa.

Operation

The Serial Peripheral Interface 803 as shown herein can operate with a single master device and with one or more slave devices. If a single slave device is used, the Slave Select pin may be fixed to logic low if the slave permits it. Some slaves require the falling edge (high→low transition) of the chip select to initiate an action such as conversion on said transition. With multiple slave devices, an independent Slave Select signal is required from the master for each slave device. Most slave devices have tri-state outputs so their Master Input, Slave Out signal becomes high impedance ("disconnected") when the device is not selected. Devices without tri-state outputs cannot share Serial Peripheral Interface 803 segments with other devices; only one such slave could talk to the master, and only its chip select could be activated.

Data Transmission

A. A Typical Hardware Setup Using Two Shift Registers to Form an Inter-Chip Circular Buffer To begin a communication, the master first configures the clock, using a frequency less than or equal to the maximum frequency the slave device supports. The master then pulls the chip select low for the desired chip. If a waiting period is required (such as for analog-to-digital conversion), then the master must wait for at least that period of time before starting to issue clock cycles.

During each Serial Peripheral Interface 803 clock cycle, a full duplex data transmission occurs:

the master sends a bit on the Master Output, Slave Input line; the slave reads it from that same line; and the slave sends a bit on the Master Input, Slave Output line; the master reads it from that same line.

Transmissions normally involve two shift registers of some given word size, such as eight bits, one in the master and one in the slave; they are connected in a ring. Data usually are shifted out with the most significant bit first, while shifting a new least significant bit into the same register. After that register has been shifted out, the master and slave have exchanged register values. Each device then takes that value and does something with it, such as writing it to memory. If there are more data to exchange, the shift registers are loaded with new data and the process repeats. Transmissions may involve any number of clock cycles. When there are no more data to be transmitted, the master stops toggling its clock. Normally, it then deselects the slave.

Transmissions often consist of 8-bit words, and a master can initiate multiple such transmissions if it wishes/needs. However, other word sizes are also common, such as 16-bit words for touchscreen controllers or audio codes; or 12-bit words for many digital-to-analog or analog-to-digital converters. Every slave on the bus that hasn't been activated using its chip select line must disregard the input clock and Master Output, Slave Input signals, and must not drive Master Input, Slave Output. The master must select only one slave at a time.

Clock Polarity and Phase

Figure 12:
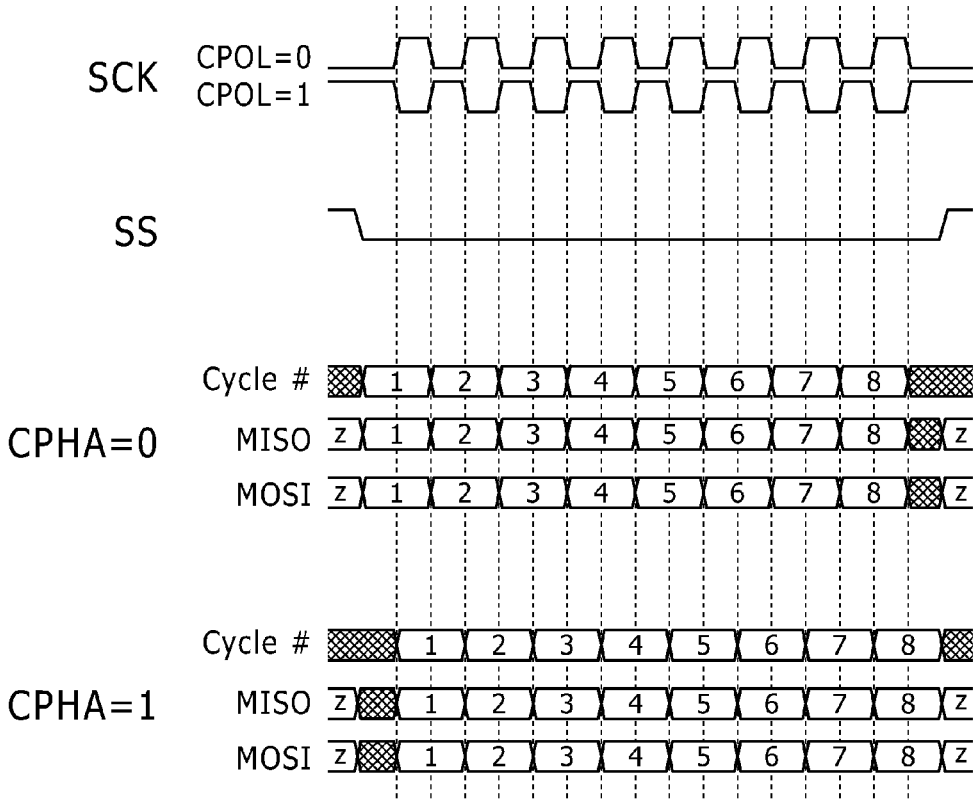
FIG. 12 illustrates a timing diagram of the clock and signal leads typically found on the Serial Peripheral Interface.

In addition to setting the clock frequency, the master must also configure the clock polarity and phase with respect to the data. The timing diagram is shown in FIG. 12. The timing is further described below and applies to both the master and the slave device.

At CPOL=0, the base value of the clock is zero:

- For CPHA=0, data are captured on the clock's rising edge (low→high transition) and data are propagated on a falling edge (high→low clock transition).
- For CPHA=1, data are captured on the clock's falling edge and data are propagated on a rising edge.

At CPOL=1, the base value of the clock is one (inversion of CPOL=0):

- For CPHA=0, data are captured on clock's falling edge and data are propagated on a rising edge.
- For CPHA=1, data are captured on clock's rising edge and data are propagated on a falling edge.

That is, CPHA=0 means sample on the leading (first) clock edge, while CPHA=1 means sample on the trailing (second) clock edge, regardless of whether that clock edge is rising or falling. Note that with CPHA=0, the data must be stable for a half cycle before the first clock cycle. For all CPOL and CPHA modes, the initial clock value must be stable before the chip select line goes active.

Powered Control Module Software Architecture

FIG. 9 illustrates in block diagram form the software architecture of the Powered Control Module 700, such as that resident in Weapon Accessory Control System 1300. The Initialization Module 901 runs from power-on or reset. This unit calls the following initialization functions which are stored in PCM Configuration Memory 9011, in the sequence indicated below. Note that specific calls may be skipped based on the device type; for example, a flashlight need not initialize button inputs, and a handgrip need not initialize the Pulse Width Modulation function:

Device initialization:
Flash parameter load
Timers and timeouts
Serial Peripheral Interface
Front End (RF Driver)
Pulse Width Modulation
Communications Initialization:
Connection data structures
Connection state machines
RF driver initialization B. Main Loop Entry Main Processing Loop During Main Loop 902 execution, the Microcontroller 801 services interrupts that are received from the Front End Chip 802, timers, and external discrete signals (e.g., buttons 921 via debounce process 903), as well as the associated power-consuming accessory via lead Input. The interrupts result in changes of state within data structures (such as connection tables 9014, button status variables). The Main Loop 902 within Microcontroller 801 services input messages (by calling connectPoll) and queued button events. If the Main Loop 902 determines that no activity has occurred, it places the Microcontroller 801 in a low-power (idle) state. An interrupt from any of the Serial Peripheral Interface 803 (indicating a message receive), a timer, or a button press, awakens the Microcontroller 801, and the debounce software 903 places an entry in a debounce FIFO as a result of a button press. The Main Loop 902 calls the Device Controller software 904, which retrieves translation data from Device Type Table 9012. A message process 906 is activated to initiate a connection via Connection Process 907 and Connections Table 9014 (as described in more detail below). Microcontroller 801 routes the event by RF Driver process 908 and Serial Peripheral Interface Driver process 909 to output the control signals over the Powered Rail 24 (via Front End Chip 802 and Serial Peripheral Interface 803) to an appropriate power-consuming accessory using the button rules table 9013.

For a Powered Control Module 700 located in a power-consuming device, the connect functions place an entry in the debounce FIFO; therefore, the device "sees" button requests from the Microcontroller 801. The Main loop 902 services the debounce FIFO and calls the device specific function, such as Pulse Width Modulation Control 905, which acts on the button event, usually by adjusting the Pulse Width Modulation output 922.

Discovering and Enumerating a Device

When a power-consuming accessory is attached to the Powered Rail 24, the Powered Control Module 700 located in the power-consuming accessory executes power-up reset software. The software determines the device type (from internal flash parameters) and sends an unprotocolled "hello" message to destination address 0x01 (the controller). The Powered Control Module 700 waits for a response message. If no response message is received within 500 mSec, the Powered Control Module 700 resends the message. The discovery message contains device-specific information, including the device type and sub-type, and capabilities and options.

The Powered Control Module 700 located in the receiving power-consuming accessory, upon receiving a hello message, performs the following processing:

- It examines the current connections to determine if this is a duplicate entry. If so, the connection entry is reset, and the last assigned address is re-used.
- Otherwise, it assigns a unique address to the device. Addresses are assigned by incrementing the last assigned address, skipping broadcast addresses, and skipping addresses that are currently in use.
- It updates its internal tables—it records the device information and the newly assigned address.
- It initializes data structures used to control send and receive connections with the device.
- It marks the connections so that it requires a keepalive message.
- It sends an unprotocolled (hello response) to the device using the broadcast address.
- The broadcast address must be used since the device is not yet aware of its logical device.

The remote power-consuming accessory, upon receiving the response, initializes its connection data structures, and programs its RF interface to recognize its unique address.

Virtual Buttons

Before sending a button event message to a device, the Microcontroller 801 translates the button event from a physical button event to a virtual button event. Consider the case where a power-consuming device 701 located in the power-consuming accessory 8 is controlled by two buttons. For example, suppose a power-consuming accessory 8 uses button one to turn the tactical light 701 on or off, and button two to strobe the tactical light 701. If the tactical light 701 and Weapon Accessory Control System 1300 are the only devices on the Powered Rail 24, then buttons one and two control the tactical light 701.

Suppose now that a second device 7 is attached to the Powered Rail 24, and that the button rules assign button one to this new device 7, and buttons two and three to the tactical light 701. When buttons two or three are pressed, the tactical light 701 receives a button-event message showing that buttons one or two were pressed. The button rules software maps buttons so that each device "thinks" it starts with button one.

Packet transfers between the Microcontroller 801 and the Front End Circuit 802 are accomplished by placing the Front End Circuit 802 in standby mode and transferring the packet over the Serial Peripheral Interface 803. A send packet function interrogates the Front End Circuit 802 to determine if signals are active on the Powered Rail 24. This is accomplished by reading the Receive Signal Strength Indicator where, if its value is above a fixed threshold, the function returns a status indicating that the signal initiator should retry. Otherwise, the function places the Front End Circuit 802 into standby mode, loads the packet into the Front End Circuit FIFO, and then places the Front End Circuit into transmit mode. The function then polls for completion of transmission by interrogating the INT1 input from the Front End Circuit 802. After the Front End Circuit 802 indicates the last bit is in progress, the software sends a Serial Peripheral Interface command to place the Front End Circuit 802 back into receive mode.

Packet Receive

The packet receive function examines the INT1 input signal to determine if it is asserted. The Front End Circuit 802 asserts this signal when a packet, qualified as having a good CRC and either a broadcast address or a matching node address, is in the FIFO. This function places the Front End Circuit 802 into standby mode, empties the Front End Circuit FIFO into a local buffer, and returns the Front End Circuit to receive mode. This function then posts the received message into a receive packet queue.

Packet Get

The packet receive function moves a packet from the Front End Circuit 802 into the packet receive FIFO. The user (in this case, the connection functions) calls the packetGet function to retrieve a packet from the FIFO. This approach provides a modest amount of buffering, and it removes the packet from the Front End Circuit 802 as soon as possible, freeing the Front End Circuit and allowing it to receive additional messages.

Set Node Address

The Serial Peripheral Interface 803 provides functions to set and clear the node address. This address is an 8-bit value; the Front End Circuit 802 receives packets destined for either broadcast addresses or for the address specified within this register. During RF interface initialization, this register is set to the broadcast address. Subsequent software sets this register to 0x01 (the grip, or controller address) or to another value (for other devices) determined during enumeration.

Connection Functions

The Connection Functions 907 form the core of the Serial Peripheral Interface protocol. These functions move packets between upper level applications and the RF driver. These functions manage serial numbers and provide acknowledges and retries. These functions also support connection establishment and teardown. A connection is torn down after a node fails to acknowledge a message multiple times. Whenever a new node connects, or whenever a connection is torn down, the connection unit updates a list of connected devices. This list is made available to the button rules unit, which re-computes the relationship between buttons and remote nodes.

The Connection Table 9014 is a local table managed by the connection software 907. For each active connection, a table entry includes serial number information, a send buffer and a receive buffer, and timer information to manage retries. Device information, gleaned from the "hello" message, is also stored within the connection table 9014.

Connect Initialization

The initialization function 901 is called during reset. It clears connection data structures and creates a connection entry in Connection Table 9014 for the "broadcast address." This entry has a fixed node address of 0x00. The caller passes a node address to this function. If the node is the Weapon Accessory Control System 1300, then this function calls the RF set node address function to program the Front End Circuit 802 to receive messages destined for this node. If the node is not Weapon Accessory Control System 1300 node, the caller passes 0. In this case, the initialization function creates an entry with address 0x01 for the purpose of communicating with the Weapon Accessory Control System 1300 node.

Connect Connect

The "connect connect" function processes "hello" messages from other (remote) nodes. This function is normally used on the controller function. This function searches for a matching entry within the Connection Table 9014 based on device type, subtype, and serial number. A matching entry is reset, but its node address is re-used. (This scenario occurs when a node retries its hello message because the prior hello message was processed but the response was lost.) If no matching entry exists, this function finds an unused entry in the Connection Table 9014, and populates it with information from the hello message, marking the entry as "used." The sequence numbers for the next transmit and receive serial numbers are set to the lowest serial number. Unless this function is re-using the node address from a matching entry, it assigns a new node address, confirming that the new address is not in use within other Connection Table 9014 entries.

This function returns the node address to the caller. If no connect entry is available, this function returns 0 to the caller. For a nonzero response, the caller normally sends a "hello response" message to the initiating node.

Connect Poll

This function implements the main state machinery for the Serial Peripheral Interface protocol. The connect poll function is called from the main loop 902 for each loop iteration. The poll function is divided into two phases. The first phase performs the following processing:

- The receive processing phase services the receive packet queue. Incoming messages are examined and processed as follows, until the receive queue is emptied.
- If the incoming message has a nonzero acknowledge field, the Acknowledge serial number is processed. If it matches an Acknowledge for which this node is waiting, the software clears the acknowledge wait flag, cancels the send retry timer, and marks the send buffer so that it is available.
- Next, the software determines if the received message is a duplicate (indicated by a "past" serial number). If so, the function schedules a "send acknowledge" for the message but otherwise discards the message, since it is a duplicate.
- Next, the software determines if the message is unprotocolled, or if it matches the next expected protocolled serial number. If either of these conditions is true, and if the receive buffer is empty, the protocol copies the message into the connect receive buffer and marks the buffer full. For a protocolled message, the function also schedules a "send acknowledge."

The receipt of any protocolled message causes the polling loop to cancel and restart a keep alive timer for the connection.

If the receive buffer is full after the above processing, this function calls the Message Service function, which interprets the message contents.

The second phase performs transmit processing. For each active connection in the Connection Table 9014, the second phase performs the following processing:

If the transmit buffer is non-empty and the resend timer has expired, this function determines if the maximum number of send retries has been reached. If so, the connection is deleted from the Connection Table 9014, and the connect poll function re-computes the list of connected devices.

Otherwise, this function calls the RF send packet function. If the RF send packet function returns nonzero, then the poll function moves on to the next connection entry; the resend must be retried with the next call to Connect Poll. If the RF send packet function returned nonzero, then the packet was sent: this function increments the retry count, and starts a new resend timer. Prior to the send, this function embeds any receive acknowledge into the message (the "piggyback acknowledge").

If the transmit buffer is empty but an acknowledge response is pending, and if the acknowledge timer has expired, this function constructs and sends an acknowledge-only packet.

If none of the above conditions are true but the keepalive timer has expired, this function places a "ping" message into the send buffer and marks the buffer as full. The next call to Connect Poll will send the ping message.

The connect poll function returns a status indicating whether or not any message activity has occurred. The main loop 902 uses this information to determine when it is appropriate to transition to an idle state.

Connect Send

The connect send functions send protocolled or unprotocolled messages to another node. These functions check the message length and validate that the destination address is either a broadcast address or the address of a connected node. If the transmit buffer within the connect data structure is empty, these functions copy the message data into the buffer and mark the buffer "full." The protocolled message send function also assigns the next serial number to the message. Subsequent calls to the Connect Poll function transmits the pending message. Connect Poll retries protocolled messages until an acknowledge is received or until the maximum number of retries has been reached.

Connect Sort

Connect Sort is an internal function, called whenever a device connects or disconnects (indicated by excessive retries). The connect sort function creates a sorted list of connected devices; the list is sorted in ascending order by device type, subtype, and serial number. After sorting the list, this function calls the button rule reset function, which determines the mapping of buttons to target devices.

Peer to Peer Connections

Figure 10:
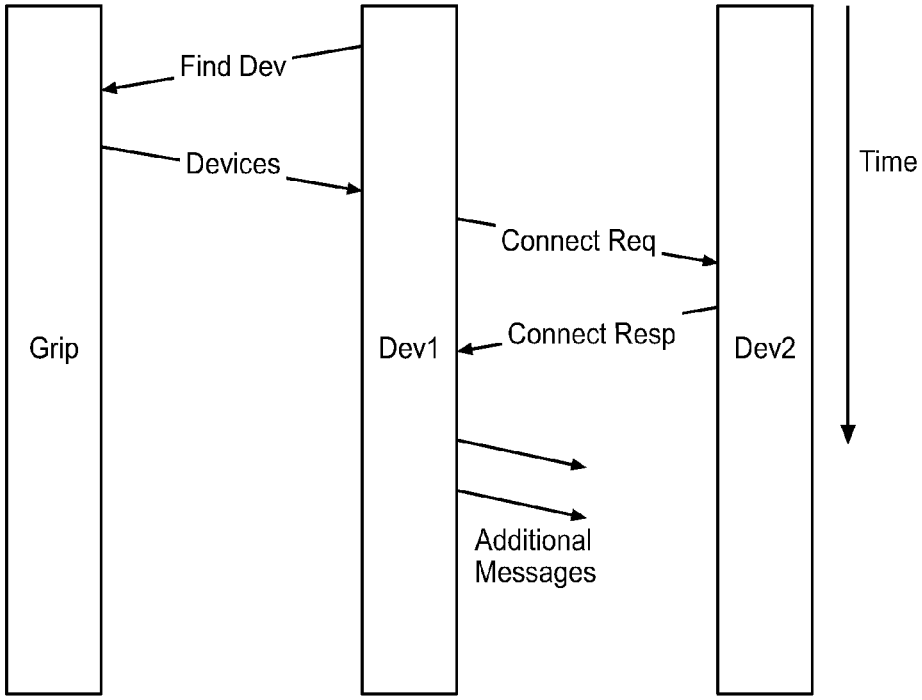
FIGS. 10 and 11 illustrate the signal flow in a peer-to-peer and a protocolled message, respectively.
Figure 11:
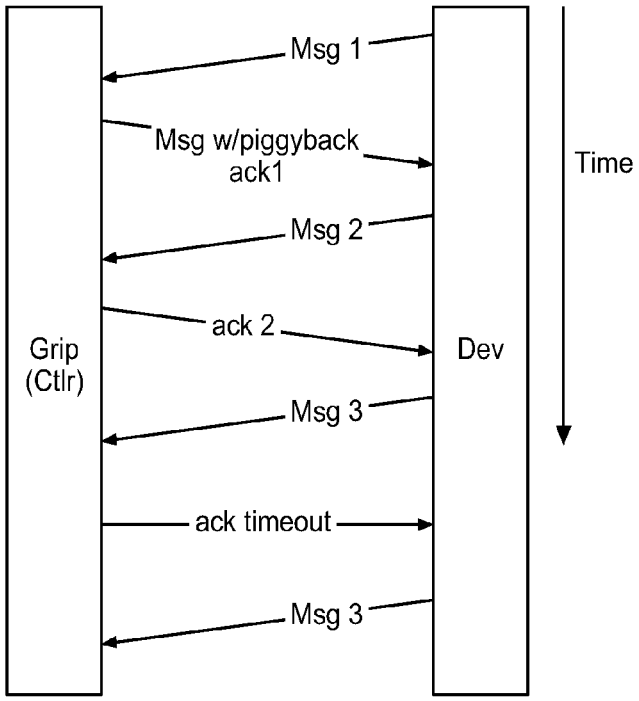

FIGS. 10 and 11 illustrate the signal flow in a peer-to-peer and a protocolled message, respectively. Power-consuming devices typically only establish connections with the Weapon Accessory Control System 1300 node, and are not aware of other power-consuming devices. However, a power-consuming device may send a message to the Microcontroller 801 that interrogates the Microcontroller's tables and determines if a power-consuming device of a specific type is also connected. The Microcontroller 801 provides a response message indicating either that such a power-consuming device is not connected, or it is connected and has a specific logical address. Once a power-consuming device determines (from the Microcontroller 801) that a peer of interest is connected, the power-consuming device sends an unprotocolled connection request message and waits for an unprotocolled connection response. Since both power-consuming devices have unique addresses assigned by the Weapon Accessory Control System 1300 node, broadcast messages are not required. After a connection response, both power-consuming devices update their internal connection tables to include information regarding the peer connections. The power-consuming devices then are free to exchange messages using the assigned addresses.

Protocolled Messages

Protocolled messages use a sliding window protocol having a window length of one message. Once a connection is established, connected nodes obey a strict set of rules for sending and receiving messages:

The sender assigns a unique serial number to the message. The serial number is chosen from a range of 0x80 to 0xff.

After sending the message, the sender maintains a copy of the message for resend until an acknowledge is received or until the connection is declared void.

The sender periodically resends the message until an acknowledge is received. The resend time is a random value between resend_min and resend_max msec.

A receiver performs the following processing for a protocolled message:

The receiver examines the serial number to determine if it matches the next expected serial number, or if it is a resend from the past.

If the message is a resend from the past, the receiver transmits an acknowledge, but discards the message. The message is considered a duplicate—a resend because the last acknowledge from the receiver to the transmitter occurred after the transmitter's resend timer expired.

If the message matches the next expected message, the receiver transmits an acknowledge and processes the message. The receiver then increments the next expected message serial number.

Collision Avoidance

The Powered Rail 24 is a single bus, where multiple units can transmit data at any time. This invites the possibility of a collision, where multiple units transmit at the same time. This will destroy the integrity of the packets from both senders, and no receivers will see a resulting packet with a good CRC. In order to avoid collisions, the software resident in the Powered Control Modules 700 employs the following safeguards:

Before sending, a Powered Control Module 700 interrogates the analog front end to determine if Receive Signal Strength Indicator is active. This indicates that another node is sending.

If Receive Signal Strength Indicator is active, the protocol polling function proceeds to the next entry; the transmission is deferred until the next call to the protocol polling function.

Checking Receive Signal Strength Indicator before sending is a safeguard; it is still possible for two nodes to check Receive Signal Strength Indicator at the same time and for both to decide to send at the same time. For this condition, the timeout/retry mechanism of the protocol will detect the absence of an Acknowledge and resend the message.

Button Rules Table

The Button Rules Table 9013 is a static table used by the Weapon Accessory Control System 1300 node. This table determines the power-consuming accessories to which messages are sent when a button event occurs. This table contains multiple rows: each entry has a list of power-consuming accessories in ascending order. When a power-consuming accessory is attached or removed, the Weapon Accessory Control System 1300 node updates the Device Types Table 9012, and then scans the Button Rules Table 9013 for an entry matching the new configuration. Therefore, the Button Rules Table 9013 is searched only when a power-consuming accessory is added to or removed from the Powered Rail 24.

An entry in the Button Rules Table 9013 looks like this:

type-1 type-2 type-3 type-4 rules

The "type" is a 16-bit value indicating, for example, a flashlight device 8. The "rules" field is a 4-byte entry; each position in the 4-byte string corresponds to a button. When a button event occurs, the control software examines the entry in Button Rules Table 9013 that was selected when a power-consuming accessory was last attached to or removed from the Powered Rail 24. The software finds the rule for the corresponding button. The entry is an index into the Device Table 9012. Therefore, the index tells the software that the button should be routed to the nth entry in the Devices Table 9012: for example, button 2 may be routed to the 3rd entry in the array, which may be an optical device 7.

Since the types array in the Button Rules 9013 entry matches the Device Types Table 9012, the software uses the address within the Device Types Table 9012 in order to determine the destination address of the flashlight 8. The software then constructs and sends a message reporting the button press event. A type of "0" indicates no power-consuming accessory is connected. A rule value of "x" is a don't care value. The software described as an example herein supports three types of devices: handgrip, flashlight, and optics. Therefore, example entries are:

| type-1 | type-2 | type-n | rules | Notes |
|---|---|---|---|---|
| 0 | 0 | 0 | x-x-x-x | Handgrip only |
| Flashlight | 0 | 0 | 0-0-x-x | $1^{st}$ 2 buttons - flashlight |
| Optics | 0 | 0 | 0-x-x-x | $1^{st}$ button - optics |
| Flashlight | Optics | 0 | 0-0-1-x | $1^{st}$, $2^{nd}$ - flashlight, $3^{rd}$ - optics |

Virtual Buttons

Before sending a button event message to a power-consuming accessory, the Weapon Accessory Control System 1300 node translates the physical button number to a virtual button number. This power-consuming accessory needing two buttons receives messages indicating that the first and second buttons were pressed, even if the Weapon Accessory Control System 1300 node assigned buttons three and four to the power-consuming accessory. In this case, button three is the "first" button pertaining to the power-consuming accessory, and button four is the "second" button pertaining to the power-consuming accessory.

Connections Table

Each Powered Control Module 700 maintains a table containing connection information. The Weapon Accessory Control System 1300 node has connections to and from all power-consuming accessories. Any power-consuming accessory has a connection to and from the Weapon Accessory Control System 1300 node. For some power-consuming accessories, the Powered Control Module 700 software may also establish connections to other power-consuming accessories (peer-to-peer connections). An entry in the connection table has the following information:

The connection status: not used, or firm (in use);

Whether a message is waiting to be sent;

Whether a message has been received;

Whether this device should generate "keepalive" ping messages;

The logical address assigned to the remote device;

The total number of resends for the current message;

Countdown timer values for sending or resending;

A single send or receive buffer;

An indication of whether the buffer is empty or available;

Device information from the original "hello" message;

Statistics may be maintained to assist with debug and performance testing:

Message sends;

Message resends;

Messages received; and

Acknowledges sent.

In addition to an entry for each connection, this table also includes an entry for broadcast operations.

SUMMARY

There has been described a Weapon Accessory Control System. It should be understood that the particular embodiments shown in the drawings and described within this specification are for purposes of example and should not be construed to limit the invention, which is described in the claims below. Further, it is evident that those skilled in the art may make numerous uses and modifications of the specific embodiment described without departing from the inventive concepts. Equivalent structures and processes may be substituted for the various structures and processes described; the subprocesses of the inventive method may, in some instances, be performed in a different order; or a variety of different materials and elements may be used. Consequently, the invention is to be construed as embracing each and every novel feature and novel combination of features present in and/or possessed by the apparatus and methods described.

What is claimed as new and desired to be protected by Letters Patent of the United States is:

1. A weapon accessory control system comprising:

at least one Powered Rail extending along at least a portion of a length of a barrel of a weapon and electrically connected to a source of electrical power, for providing a source of electrical power to at least one power-consuming accessory that is mechanically and electrically attached to the Powered Rail, comprising:

a first electrical contact and a second electrical contact for providing a first electrical connection and a second electrical connection to said power source, respectively, via a first power conductor and a second power conductor, and wherein mechanical mounting of a power-consuming accessory on the Powered Rail electrically connects said power-consuming accessory via said first and second electrical contacts to said first and second power conductors;

an accessory control apparatus for enabling a user to select command and control functions for each power-consuming accessory connected to the Powered Rail;

a powered control module located in said power consuming accessory, responsive to electrically connecting said power-consuming accessory via said first and second electrical contacts to said first and second power conductors, for transmitting device-specific data to said accessory control apparatus to define the power consuming accessory; and wherein the accessory control apparatus includes a powered control module, electrically connected to the Powered Rail and responsive to the user selecting a command and control function for a particular power-consuming accessory, for transmitting control signals indicative of the user selecting a command and control function for a particular power-consuming accessory to the powered control module located in the particular power-consuming accessory via the first and second power conductors of the Powered Rail, which are shared by all of the power-consuming accessories that are mounted on the Powered Rail, to control the operation of the particular power-consuming accessory.

2. The weapon accessory control system of claim 1 wherein said powered control module comprises:

a microcontroller which is maintained in an off state in the absence of an interrupt, user button push, or timer expiration.

3. The weapon accessory control system of claim 1, further comprising:

wherein said accessory control apparatus comprises:

a plurality of buttons, located in a Powered Rail and operable by a user of the weapon, each of which corresponds to a predetermined operation of a selected power-consuming accessory; and wherein said powered control module comprises:

a button rules table which stores data indicative of a predetermined operation to be performed by the power-consuming accessory in response to data received from the Powered Rail indicative of a button push operation performed by the user.

4. The weapon accessory control system of claim 3 wherein said powered control module further comprises:

a device type table which stores data indicative of characteristics of power-consuming accessories that can be connected to the Powered Rail.

5. The weapon accessory control system of claim 1 wherein said powered control module comprises:

a connection table which stores data indicative of the power-consuming accessories connected to the Powered Rail with which the weapon accessory control system is communicatively coupled via the Powered Rail.

6. The weapon accessory control system of claim 1 wherein the powered control module, when located in a power-consuming accessory, comprises:

a power regulator, which is responsive to the control signals received from the weapon accessory control system via the Powered Rail, for regulating the flow of power from the Powered Rail to a device in the power-consuming accessory which draws power from the Powered Rail.

7. The weapon accessory control system of claim 6 wherein the power regulator comprises:

a Pulse Width Modulation controller for regulating the flow of power from the Powered Rail to a device in the power-consuming accessory which draws power from the Powered Rail.

8. The weapon accessory control system of claim 1 wherein said powered control module comprises:

a signal generator for generating a plurality of signals, each unique to a predetermined power-consuming accessory.

9. The weapon accessory control system of claim 8 wherein said accessory control apparatus is connected to said signal generator for enabling a user to control the generation of said plurality of signals by said signal generator.

10. The weapon accessory control system of claim 9 wherein said powered control module further comprises:

a transceiver operatively connected to said signal generator for coupling each of said plurality of signals to said at least one Powered Rail.

11. A method of operating a weapon accessory control system for use with at least one Powered Rail that extends along at least a portion of a length of a barrel of a weapon and electrically connected to a source of electrical power, to provide a source of electrical power to at least one power-consuming accessory that is mechanically and electrically attached to the Powered Rail, comprising: a first electrical contact and a second electrical contact for providing a first electrical connection and a second electrical connection to said power source, respectively, via a first power conductor and a second power conductor, and wherein mechanical mounting of a power-consuming accessory on the Powered Rail electrically connects said power-consuming accessory via said first and second electrical contacts to said first and second power conductors;

enabling a user to select command and control functions for each power-consuming accessory connected to the Powered Rail on an accessory control apparatus connected to the Powered Rail;

transmitting from a powered control module located in said power-consuming accessory, that is responsive to electrically connecting said power-consuming accessory via said first and second electrical contacts to said first and second power conductors, device-specific data to said accessory control apparatus to define the power-consuming accessory; and transmitting control signals from a powered control module located in the accessory control apparatus, electrically connected to the Powered Rail and responsive to the user selecting a command and control function for a particular power-consuming accessory, indicative of the user selecting a command and control function for a particular power-consuming accessory to the particular power-consuming accessory via the first and second power conductors of the Powered Rail, which are shared by all of the power-consuming accessories that are mounted on the Powered Rail, to control the operation of the particular power-consuming accessory.

12. The method of operating a weapon accessory control system of claim 11 wherein said step of transmitting control signals comprises:

maintaining a microcontroller, located in the powered control module, in an off state in the absence of an interrupt, user button push, or timer expiration.

13. The method of operating a weapon accessory control system of claim 11, further comprising:

wherein said step of enabling a user comprises:

presenting a plurality of buttons, located in the accessory control apparatus and operable by a user of the weapon, each of which corresponds to a predetermined operation of a selected power-consuming accessory; and wherein said step of transmitting control signals comprises:

storing data, in a button rules table, indicative of a predetermined operation to be performed by the power-consuming accessory in response to data received from the Powered Rail indicative of a button push operation performed by the user.

14. The method of operating a weapon accessory control system of claim 13 wherein said step of transmitting control signals further comprises:

providing a device type table which stores data indicative of characteristics of power-consuming accessories that can be connected to the Powered Rail.

15. The method of operating a weapon accessory control system of claim 11 wherein said step of transmitting control signals comprises:

providing a connection table which stores data indicative of the power-consuming accessories connected to the Powered Rail with which the weapon accessory control system is communicatively coupled via the Powered Rail.

16. The method of operating a weapon accessory control system of claim 11 wherein the step of transmitting control signals, when executed in a power-consuming accessory, comprises:

regulating, in response to the control signals received from the weapon accessory control system via the Powered Rail, the flow of power from the Powered Rail to a device in the power-consuming accessory which draws power from the Powered Rail.

17. The method of operating a weapon accessory control system of claim 16 wherein the step of regulating comprises:

operating a Pulse Width Modulation controller for regulating the flow of power from the Powered Rail to a device in the power-consuming accessory which draws power from the Powered Rail.

18. The method of operating a weapon accessory control system of claim 11 wherein said step of transmitting control signals comprises:

generating a plurality of signals, each unique to a predetermined power-consuming accessory, in a signal generator.

19. The method of operating a weapon accessory control system of claim 18 wherein said accessory control apparatus is connected to said signal generator for enabling a user to control the generation of said plurality of signals by said signal generator.

20. The method of operating a weapon accessory control system of claim 19 wherein said step of transmitting control signals further comprises:

coupling each of said plurality of signals to said at least one Powered Rail.

* * * * *